United States Patent [19]

Olson

[11] 4,005,296

[45] Jan. 25, 1977

[54] DISC SWITCH

[75] Inventor: Robert K. Olson, St. Paul, Minn.

[73] Assignee: Medtronic, Inc., Minneapolis, Minn.

[22] Filed: Oct. 29, 1974

[21] Appl. No.: 518,496

[52] U.S. Cl. ..... 200/85 R; 128/423 W; 340/272

[51] Int. Cl.[2] ..... H01H 3/14

[58] Field of Search ..... 200/159 B, 85 R, 85 A, 200/DIG. 2; 340/272; 128/423 W

[56] References Cited

UNITED STATES PATENTS

| | | | |
|---|---|---|---|
| 3,083,712 | 4/1963 | Keegan, Jr. | 128/423 |
| 3,204,637 | 9/1965 | Frank et al. | 128/423 |
| 3,209,089 | 9/1965 | Weissburg | 200/86 R |
| 3,688,066 | 8/1972 | Adelson et al. | 200/159 B |
| 3,702,999 | 11/1972 | Gradisar | 340/272 |
| 3,777,086 | 12/1973 | Riedo | 200/DIG. 2 |
| 3,806,673 | 4/1974 | Boulanger | 200/159 B |
| 3,808,384 | 4/1974 | Boulanger | 200/159 B |
| 3,811,025 | 5/1974 | Bach | 200/159 B |

*Primary Examiner*—David Smith, Jr.
*Attorney, Agent, or Firm*—Lew Schwartz; Wayne A. Sivertson

[57] ABSTRACT

Apparatus adapted for cooperation with the human foot for performing a switching function in response to ambulation. A substrate is provided with a generally centrally located contact. Posts extend from the substrate and space a flexible disc from the contact while allowing the central portion of the disc to flex into electrical communication therewith. The assembly may be positioned in the heel portion of a shoe insole so as to switch between open and closed positions as weight is placed on the heel and removed, as in walking. The switch may be employed in association with muscle and/or nerve stimulators for objectives such as combating foot drop or providing hip stabilization. In addition, proper selection of the flexible disc and post spacing will provide a normally open switch which will close when a preselected limb load has been applied. Also, the apparatus may be made bi-directional such that the same insole assembly may be employed with either foot.

18 Claims, 4 Drawing Figures

DISC SWITCH

BACKGROUND OF THE INVENTION

It is known that muscle contraction may be effected through electrical stimulation of the muscle and/or the appropriate nerve. In some instances, the stimulation is cycled in accordance with a preselected program. For example, the well known cardiac pacemakers stimulate the heart in accordance with predetermined requirements of heart activity which requirements are generally independent of the patient's activity. However, in other instances it is necessary to perform a switching function in response to a particular activity of the patient.

It is known that foot drop can be combated with appropriate electrical stimulation applied at the proper time. For example, when a patient with foot drop walks, the foot drop is most effectively overcome by applying stimulation when the foot in question, and particularly the heel, is lifted. The stimulation should then be stopped when the foot is again placed on the floor. Similarly, some patients require an artificially induced muscle contraction to allow them to stand without mechanical aids. The stimulation to provide this contraction should be applied while the foot is on the floor and removed when the foot leaves the floor. While one of these examples requires an artifically induced muscle contraction while the foot is on the ground and the other requires such a contraction when the foot is off the ground, it is apparent that an efficient device which switches between open and closed positions in response to the foot contacting and leaving the ground will be suitable for both.

SUMMARY OF THE PRESENT INVENTION

The present invention provides apparatus adapted for cooperation with the human foot for performing a switching function in response to the foot's contacting and leaving the ground. A substrate is provided with a generally centrally located contact, the substrate and contact preferably being a printed circuit board. Posts extend from the substrate and space a flexible disc from the contact while allowing the central portion of the disc to flex into electrical communication with the contact. The assembly may be positioned in the heel portion of a shoe insole so as to cause the disc central portion to flex as weight is placed on the heel. When the heel is lifted, a central disc portion will return to its original spaced configuration.

The switch of the present invention may be employed in association with known muscle and/or nerve stimulators for objectives such as combating foot drop or providing hip stabilization. In addition, proper selection of the flexible disc and the post spacing will provide a normally open switch which will close when a preselected limb load has been applied. In this manner, the apparatus of the present invention may be employed for limb load monitoring. In a preferred embodiment of the present invention, the switch is made bi-directional by providing a substrate with contacts on opposing surfaces and flexible discs spaced from each. When such a bi-directional switch is housed within a shoe insole, the same insole assembly may be employed with either foot.

The many objects, advantages and novel features of the present invention will become apparent from the following detailed description when considered in conjunction with the accompanying drawings.

DETAILED DESCRIPTION OF THE DRAWINGS

It is to be understood that within this specification and claims, the term "ambulation" is intended to encompass not only the process of walking but also the act of placing a foot on the ground and placing a load thereon.

Figure 1:
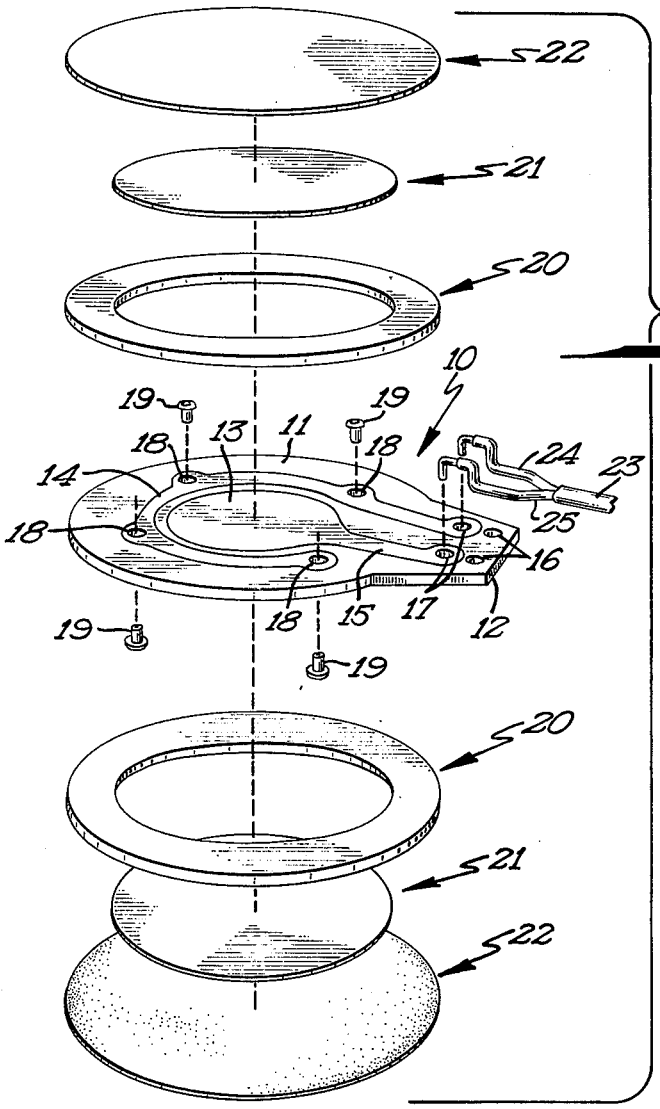
FIG. 1 shows an exploded view of a preferred embodiment of the present invention.
Figure 2:
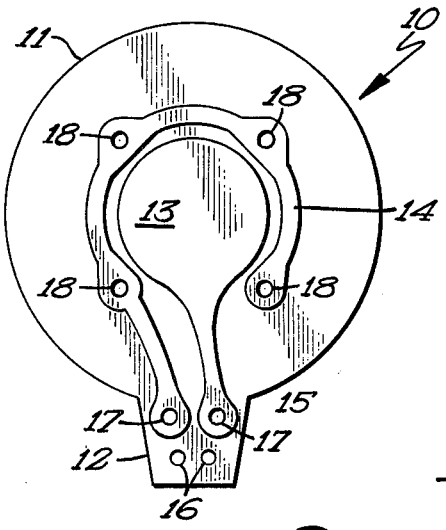
FIG. 2 shows the reversed side of one of the elements illustrated in the preferred embodiment of FIG. 1.
Figure 4:
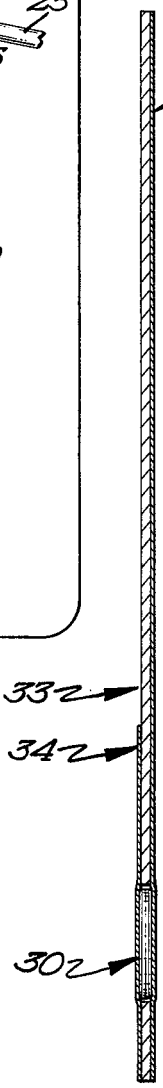
FIG. 4 shows a cross section taken along the lines 4—4 in FIG. 3.

Referring now to FIG. 1, there is shown an exploded view of a preferred embodiment of the present invention. A flat substrate 10 is provided with a first generally circular portion 11 and an extending portion or tang 12. The opposing sides of the circular portion 11 are each provided with two conductive members, a centrally located contact 13 and conductive path 14 generally encircling the contact 13. The conductive path 14 originates at the tang 12 while the contact 13 has a conductive path 15 extending to the tang 12. The contact 13 and conductive paths 14 and 15 on each of the opposing faces of the circular portion 11 of the substrate 10 are in opposing relation to their counterpart on the other surface such that the opposing surfaces of the substrate 10 are mirror images of each other. For example, the conductive path 14 illustrated in FIG. 1 originates at the tang 12 and extends around the contact 13 in a counterclockwise direction. FIG. 2 illustrates the substrate surface in opposing relation to that illustrated in FIG. 1 in which the conductive path 14 originates at the tang 12 and extends around the contact 13 in a clockwise direction.

Referring again to FIG. 1, the tang 12 is provided with a first set of apertures 16 and a second set of apertures 17, the apertures 16 and 17 passing through the substrate with the apertures 17 passing through the conductive path 14 and 15 on both opposing surfaces of the substrate 10. Apertures 18 similarly pass through the substrate and the conductive path 14 on both surfaces of the opposing substrate surfaces. The apertures 18 are evenly spaced around the conductive path 14 and are of a size sufficient to accept eyelets 19. The eyelets 19 are of a conductive material and are formed with a shoulder having a tubular extending portion. The tubular extending portion is inserted through the apertures 18 and is crimped on the opposite side of the substrate to form a second shoulder and hold the eyelet in position. Inasmuch as the crimped eyelet shoulder may have a different extension from the substrate than the preformed shoulder illustrated, the eyelets are alternately inserted from one substrate surface and the other as when one follows the conductive path 14.

A washer 20 is secured to each of the opposing surfaces of the substrate 10 in any convenient manner. The washers 20 have an outside diameter generally conforming to the diameter of the circular portion 11 of the substrate 10 and an inner diameter which is sufficient to clear the eyelets 19 and allow the washers 20 to come into intimate contact with the opposing surfaces of the substrate 10. The intimate contact between the washers 20 and substrate 10 may be maintained by any suitable adhesive. It has been found that a tape having a shape conforming to that of the washer and an adhesive on both sides also works to secure the washers 20 to the substrate 10. Such a tape may be a silicone coated kraft glassine paper with a film of acrylate adhesive on both sides.

A metallic disc 21 having a diameter approximately equal to, but smaller than, the inside diameter of the washers 20 is placed within the aperture of the washers 20 to rest upon the eyelets 19. The eyelets 19 space the discs 21 from the contacts 13 while making an electrical contact between the discs 21 and the conductive paths 14. The eyelets 19 engage the discs 21 toward their periphery such that the center of the discs 21 can flex into an out of contact with the contacts 13 upon the application of a force to the central region of the discs 21. The discs 21 are maintained within the aperture of washers 20 by circular members 22 having a diameter approximately equal to that of the washers 20 and the circular portion 11 of the substrate 10. The members 22 should be non-rigid so as to not dampen the flection of the discs 21 in response to a force applied to the apparatus. In addition, it is preferable that the members 22 provide some water resistance and thus water protection to the internal portions of the switch illustrated in FIG. 1. For this purpose, a moisture resistant tape may be employed, many examples of which are known to the prior art.

Electrical connections to the contacts 13 and discs 21 are made through the aperture 17 on the tang 12. A lead 23 has two insulated wires 24 and 25 which, when stripped, will be accommodated within the apertures 17. The wires may be inserted through the apertures 17 and crimped on the other side to establish contact on both sides of the substrate 10. The contacts may be soldered as desired. Alternately, the insulated portions of the wires 24 and 25 may be first fed through the aperture 16 and the stripped portions then inserted through the apertures 17 and soldered to provide a more secure connection.

A preferred form of the substrate 10, contact 13, and conductive paths 14 and 15 is a conventional circuit board having copper conductive members. However, within the intended environment of the switch of FIG. 1 the copper may tarnish and prevent an efficient electrical communication between the contacts 13 and discs 21. To overcome this, a different material may be employed for the contacts 13 and conductive paths 14 and 15. Alternately, the contacts 13 and conductive paths 14 and 15 may be of copper, as described, with a silver plating applied thereto. While the silver will also tarnish, silver tarnish conducts very well and will not interfere with the establishment of an electrical connection between the contact 13 and disc 21. The eyelets 19 may similarly be made of copper or brass with a silver plate and their passage through the substrate in contact with both of the conductive paths 14 establishes a redundant electrical path between each of the discs 21 and the wire 24.

Figure 3:
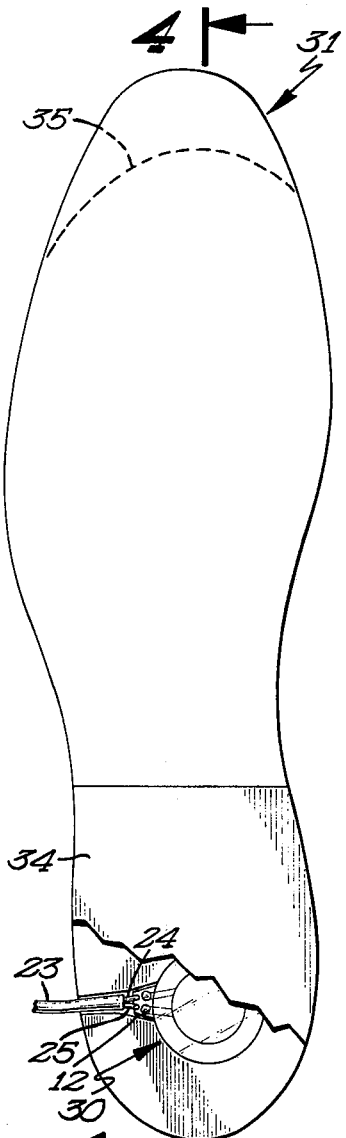
FIG. 3 shows still another preferred embodiment of the present invention.

Referring now to FIG. 3, there is shown a preferred environment of the use of the switch of FIG. 1. The switch is shown generally at 30 within the heel portion of a shoe insole 31. The location of the switch 30 within the heel portion is such that the switch will underlie the medial process of the heel when positioned within the shoe of the intended patient. The shoe insole is constructed of a first layer 32, preferably of leather. A second layer 33 may be of a material commonly employed in the construction of shoe insoles with the layers 32 and 33 being cemented together with materials commonly employed for that purpose. The member 33 has a cutout of a size which will accept the switch 30 while providing an exit path for the tang 12 and lead 23. A heel overlayment 34, again preferably of leather, is positioned over the member 33 and the switch 30 to maintain the switch in position. The overlayment 34 may be stitched, cemented or otherwise secured to the member 33. As illustrated the switch 30 has a slightly greater thickness than the member 33 such that when the insole is placed within the patient's shoe the patient will cause the uppermost disc 21 (see FIG. 1) to flex into electrical communication with its associated contact 13 by placing sufficient weight on the heel of the foot to flex the disc 21. The thickness of the disc and the unsupported disc portion as established by the spacing of the eyelets 19, may be selected such that the disc 21 will flex into electrical connection with the contact 13 at a preselected load. For example, with the same eyelet spacing, a thicker disc will require a greater force to establish the electrical connection. Thus, by proper selection of the eyelet spacing and disc thickness and material, the switch of FIG. 1 can be manufactured to "close" at a predetermined limb load. In instances where a physician desires that a patient does not over stress a leg, for example, the doctor may select a switch which will close at a predetermined maximum limb load which switch may be then employed to trigger a signal to indicate to the patient that he has overloaded his leg. Similarly, a switch of the present invention may be employed to trigger an electrical stimulator to provide the desired electrical stimulation as pressure is applied to or removed from the heel region of the foot. It has been found that a disc of 302 stainless steel having a diameter of ⅞ inch and a thickness of 0.005 inch is suitable for use as disc 21 in the last described environment when supported on posts formed by the eyelets generally at its periphery. For limb load monitoring, discs of other thicknesses may be required depending on the load being detected, the determination of disc thickness in this environment being within the scope of ordinary skill in the art.

The present invention provides an efficient, reliable switch which turns on and off in response to ambulation. However, it is to be understood that the present invention may be practiced otherwise than as specifically described. For example, there has been described a bi-directional switch which, when housed within a shoe insole may be used with either foot by simply inverting that insole. In addition, the same insole may be employed with different size shoes by merely trimming the insole, for example along the line 35 in FIG. 3 so as to be accommodated within a different shoe size. In addition, to obtain a greater resistance to moisture, the entire switch assembly may be dipped in a sealant or, alternatively, various portions of the switch may be sealed through the use of a suitable sealant, such as silicone rubber. It is therefore to be understood that, within the scope of the appended claims, the invention may be practiced otherwise than a specifically described.

What is claimed is:

1. Apparatus adapted for cooperation with the human foot for performing a switching function in response to ambulation comprising:

substrate means;

first and second contact means carried by said substrate means on opposing sides thereof;

first and second flexible contact means; and means for supporting each of said flexible contact means in a first position spaced from a different one of said first and second contact means while allowing at least a portion of said flexible contact means to flex into a second position in electrical communication with the first or second contact means from which it is spaced.

2. The apparatus of claim 1 wherein said flexible contact means comprise disc means, said supporting means comprising means engaging said disc means toward their periphery.

3. The apparatus of claim 2 further comprising insole means for housing said substrate means, contact means and supporting means generally at its heel region.

4. Apparatus adapted for cooperation with the human foot for performing a switching function in response to an ambulation load comprising:

substrate means including first contact means;

flexible disc contact means;

means for spacing said flexible disc contact means from said first contact means while allowing at least a portion of said flexible disc contact means to flex into electrical communication with said first contact means in response to said ambulation load, said spacing means comprising post means extending from said substrate means and engaging said flexible disc means toward its periphery; and means for maintaining said flexible disc contact means in a position wherein it overlies said first contact means and including washer means having a generally circular aperture, said washer means aperture having a diameter approximately equal to the diameter of said flexible disc means and said washer means being secured to said substrate means with said flexible disc contact means lying within said washer means aperture;

said first contact means comprising first contact means on each of two opposing sides of said substrate means, said flexible disc contact means, spacing means and maintaining means comprising means for independently cooperating with each of said first contact means.

5. The apparatus of claim 4 wherein said substrate means comprises a first portion containing said first contact means and a second extending portion, said washer means being generally coextensive with said substrate means first portion.

6. The apparatus of claim 4 further comprising insole means for housing said substrate means, flexible disc contact means, spacing means and maintaining means generally at its heel region.

7. The apparatus of claim 6 wherein said substrate means comprises a first portion containing said first contact means and a second extending portion, said washer means being generally coextensive with said substrate means first portion.

8. The apparatus of claim 4 wherein there is a first contact means on each of two opposing sides of said substrate means, said flexible disc contact means, spacing means and maintaining means comprising means for independently cooperating with each of said first contact means.

9. Apparatus adapted for cooperation with the human foot for performing a switching function in response to ambulation comprising insole means and pressure sensitive switch means carried within the heel region of said insole means at a location which will underlie the medial process, said switch means including:

substrate means carrying contact means on opposing surfaces thereof;

flexible electrically conductive means;

means for supporting said flexible electrically conductive means in a first position spaced from said contact means and said substrate means on each of said opposing surfaces while allowing at least a portion of said flexible electrically conductive means to flex into a second position in electrical communication with said contact means.

10. The apparatus of claim 9 wherein said flexible electrically conductive means comprises first and second disc means each being adjacent to a different one of said opposing sides, said supporting means comprising means engaging said disc means toward their periphery.

11. Apparatus adapted for cooperation with the human foot for performing a switching function in response to ambulation comprising:

printed circuit substrate means having a first generally circular portion and an extending portion;

first conductive means generally centrally located on one surface of said substrate means circular portion and extending to said substrate means extending portion;

second conductive means generally centrally located on another surface of said substrate means circular portion and extending to said substrate means extending portion, said another surface being in generally opposed relation to said one surface;

first and second electrically conductive flexible disc means;

means for supporting each of said disc means in a first position spaced from a different one of said conductive means while allowing at least a portion of said disc means to flex into a second position in electrical communication with the conductive means from which it is spaced.

12. The apparatus of claim 11 further comprising means for maintaining said disc means in a position wherein they overlie the conductive means from which they are spaced.

13. The apparatus of claim 12 wherein said maintaining means comprises two washer means each secured to and coextensive with a different one of said one and another substrate circular portion surfaces, said washer means including a generally circular aperture of a diameter approximately equal to the diameter of said disc means.

14. The apparatus of claim 13 wherein said supporting means comprises means extending from said substrate and into said washer means apertures, said disc means each lying within a different one of said washer means apertures.

15. The apparatus of claim 14 further comprising water resistant means secured over each of said washer means and washer means apertures.

16. The apparatus of claim 15 wherein said extending means comprises electrically conductive post means, the apparatus further comprising third and fourth conductive means each on a different one of said one and another substrate surfaces and extending from said substrate extending portion into contact with at least one of said post means.

17. The apparatus of claim 16 wherein at least one of said post means passes through said substrate means and extends therefrom into contact with both of said third and fourth conductive means.

18. Apparatus adapted for cooperation with the human foot for performing a switching function in response to ambulation comprising:

insole means;

substrate means carried within the heel region of said insole means, said substrate means having a first portion and a second extending portion;

first contact means carried by said substrate means at said first portion and including a conductive path means extending into said second extending portion;

second contact means carried by said substrate means at said first portion and including a conductive path means extending into said second extending portion;

flexible disc contact means;

means for spacing said flexible disc contact means from said first contact means first portion while allowing at least a portion of said flexible disc contact means to flex into electrical communication with said first contact means first portion, said spacing means including at least one electrically conductive post means extending from said substrate means and in electrical communication with said flexible disc contact means and said second contact means first portion; and means for maintaining said flexible disc contact means in a position wherein it overlies said first contact means first portion including washer means generally co-extensive with said substrate means first portion and having a generally circular aperture, said washer means aperture having a diameter approximately equal to the diameter of said flexible disc contact means and said washer means being secured to said substrate means with said fexible disc contact means lying within said washer means aperture.

* * * * *